US009360027B2

(12) United States Patent
Birkelund

(10) Patent No.: US 9,360,027 B2
(45) Date of Patent: Jun. 7, 2016

(54) PROPORTIONAL CONTROL VALVE

(75) Inventor: Michael Birkelund, Middelfart (DK)

(73) Assignee: Danfoss A/S, Nordborg (DK)

( * ) Notice: Subject to any disclaimer, the term of this patent is extended or adjusted under 35 U.S.C. 154(b) by 82 days.

(21) Appl. No.: 14/006,384

(22) PCT Filed: Mar. 20, 2012

(86) PCT No.: PCT/DK2012/000025

§ 371 (c)(1),
(2), (4) Date: Sep. 20, 2013

(87) PCT Pub. No.: WO2012/126468

PCT Pub. Date: Sep. 27, 2012

(65) Prior Publication Data

US 2014/0008555 A1 Jan. 9, 2014

(30) Foreign Application Priority Data

Mar. 21, 2011 (DK) ..... 2011 00196

(51) Int. Cl.
*F15B 13/04* (2006.01)
*F15B 13/043* (2006.01)

(52) U.S. Cl.
CPC ..... *F15B 13/043* (2013.01); *F15B 13/0431* (2013.01); *F15B 13/0433* (2013.01); *F15B 13/0435* (2013.01)

(58) Field of Classification Search
CPC ..... F15B 13/043; F15B 13/0431; F15B 13/0433; F15B 13/0435
USPC ..... 251/30.01
See application file for complete search history.

(56) References Cited

U.S. PATENT DOCUMENTS 4,592,533 A * 6/1986 Guglielmi et al. ..... 251/30.01
4,623,118 A 11/1986 Kumar
4,679,765 A * 7/1987 Kramer et al. ..... 251/38
6,017,015 A 1/2000 Heusser
6,073,652 A * 6/2000 Wilke ..... F15B 11/003 137/596.16

(Continued)

FOREIGN PATENT DOCUMENTS

EP 2270340 A1 1/2011

OTHER PUBLICATIONS

PCT Search Report for PCT Serial No. PCT/DK2012-000025 dated Jun. 27, 2012.

(Continued)

*Primary Examiner* — John K Fristoe, Jr.
*Assistant Examiner* — Daphne M Barry
(74) *Attorney, Agent, or Firm* — McCormick, Paulding & Huber LLP

(57) ABSTRACT

A proportional valve including a housing having an inlet and an outlet, and a valve element movably positioned in the housing between the inlet and the outlet. The valve element having a pilot valve opening, a first pressure chamber with a pressure acting on the valve element in a first direction, and a second pressure chamber with a pressure acting on the valve element in a second direction opposite to the first direction. A pilot valve element actuated by a drive mechanism to cooperate with the pilot valve opening to form a pilot valve. A flow resistance between the inlet and the first pressure chamber is smaller than a flow resistance between the inlet and the second pressure chamber. The pilot valve opens into a third pressure chamber connected to the outlet via a throttled flow path.

10 Claims, 1 Drawing Sheet

(56) References Cited

U.S. PATENT DOCUMENTS

| | | | | |
|---|---|---|---|---|
| 6,443,420 | B1 * | 9/2002 | Hettinger | 251/30.04 |
| 6,968,853 | B2 * | 11/2005 | Amazorrain | 137/66 |
| 6,971,232 | B2 * | 12/2005 | Singh | 60/414 |
| 2009/0212244 | A1 | 8/2009 | Pfaff et al. | |
| 2010/0327202 | A1 * | 12/2010 | Birkelund | 251/129.15 |

OTHER PUBLICATIONS

Danish Search Report Serial No. PA 2011 00196 dated Oct. 13, 2011.

* cited by examiner

PROPORTIONAL CONTROL VALVE

CROSS REFERENCE TO RELATED APPLICATIONS

This application is entitled to the benefit of and incorporates by reference subject matter disclosed in International Patent Application No. PCT/DK2012/000025 filed on Mar. 20, 2012 and Danish Patent Application No. PA 2011 00196 filed Mar. 21, 2011.

FIELD OF THE INVENTION

The present invention relates to a valve comprising a housing having an inlet and an outlet, a valve element being positioned between said inlet and said outlet, said valve element being moveable in said housing, said valve element having a pilot valve opening, a first pressure chamber, a pressure in said first pressure chamber acting on said valve element in a first direction, a second pressure chamber, a pressure in said second pressure chamber acting on said valve element in a second direction opposite to said first direction, a pilot valve element cooperating with said pilot valve opening to form a pilot valve, said pilot valve element being actuated by drive means, wherein a flow resistance between said inlet and said first pressure chamber is smaller than a flow resistance between said inlet and said second pressure chamber.

BACKGROUND

Such a valve is known from U.S. Pat. No. 6,017,015. The inlet is directly connected to the first pressure chamber. The pressure in the first pressure chamber is acting on the valve element in an opening direction. The pressure of the first pressure chamber is present also in the second pressure chamber due to a throttled flow path between the first pressure chamber and the second pressure chamber. The area of the second pressure chamber in which the pressure can act onto the valve element is larger than the corresponding area of the valve element in the first pressure chamber. Therefore, the force difference generated by the different effective areas of the valve element in the two pressure chambers act on the valve element in a closing direction.

SUMMARY

In the closed state of the valve the pilot valve is closed as well. The pressure of the second pressure chamber is present on both sides of the pilot valve element. However, this pressure does not act on the part of the valve element in the pilot valve opening. Therefore, a force difference acts on the pilot valve element in a closing direction.

A solenoid is provided to drive the pilot valve element in an opening direction against the closing force. When the pilot valve element opens the pilot valve opening the pressure in the second pressure chamber decreases. When the pressure in the second pressure chamber is sufficiently low the pressure in the first pressure chamber moves the valve element in opening direction. The valve element follows the pilot valve element. However, the pressure at the outlet of the pilot valve equals the pressure at the outlet. Therefore, relatively large forces are required to move the pilot valve element even when the pilot valve and the valve are open. The required high forces make it difficult to adjust the valve element precisely. When the valve is used as proportional valve in most cases a precise adjustment of the position of the valve element is necessary to adjust precisely the opening degree of the valve.

The task underlying the invention is to reduce the electrical power needed to operate the solenoid.

This task is forced in that the pilot valve opens into a third pressure chamber, said first pressure chamber being connected to said outlet via a throttled flow path.

When the pilot valve opens, the fluid in the second pressure chamber does not directly escape to the outlet, but only to the third pressure chamber. The further flow of the fluid is restricted by the throttled flow path. Therefore, the pressure in the third pressure chamber is between the pressure in the second pressure chamber and the pressure at the outlet. Consequently, the pressure acting in opening direction on the pilot valve element can be kept rather high so that the force difference over the pilot valve element can be kept smaller. The force necessary to move the pilot valve element can be reduced and therefore the size of the solenoid or, when the same force is used, a larger valve can be operated by the same pilot valve and the same drive means. Since smaller forces have to be overcome in order to move the pilot valve element it is easier to obtain a precise adjustment of the position of the pilot valve element and of the valve element of the valve. Such a valve is in particular suitable as proportional valve. The pressure in the third pressure chamber can act on the valve element in opening direction.

Preferably the third pressure chamber is formed between said valve element and a part of said housing. The part of the housing can be made integrally with the housing or it can be fixed to the housing. The part of the housing defines a stationary border for the third pressure chamber. The valve element defines a variable border for the third pressure chamber.

Furthermore it is preferable that the valve element is formed as a slider surrounding said part of the housing. The valve element forms a cylinder and the part of the housing forms a piston. The cylinder is moveable over the piston.

Preferably the throttled flow path is arranged between said valve element and said part of the housing. The throttled flow path can be formed e.g. by a clearance between the valve element and the part of the housing. No further machining of the valve element or the part of the housing is necessary.

Preferably an outlet channel is arranged within said part of the housing, said outlet channel being connected to said outlet, said valve element comprising a sleeve part, said sleeve part defining a control edge, said control edge being moveable over an opening in a wall of the outlet channel, said opening connecting said outlet channel to said first pressure chamber. When the valve element is moved the sleeve part closes more or less the opening in the wall of the outlet channel. The opening degree of the valve can precisely be adjusted.

Preferably the part of the housing defines a valve seat against which the valve element rests when said valve is closed. Therefore, there is no gap leakage.

Preferably the drive means have a two-step actuation. Such a two-step actuation is known from US 2010/0327202 A1. Such a two-step actuation has the advantage that in a first step a large force is generated for moving the pilot valve element. However, the movement of the pilot valve element in this first stage is rather small. Once the pilot valve is open the force for moving the pilot valve element is dramatically reduced so that in a second stage a smaller force is sufficient in order to move the pilot valve element.

Preferably the drive means comprises an electromagnetic actuator. The use of an electromagnetic actuator requires no moveable parts except the pilot valve element. The force generated by an electromagnetic actuator can be influenced by the current supplied to the actuator. The opening degree of the valve can be made proportional to the current supplied to the actuator. Therefore, the valve can be used as proportional valve.

Another preferred possibility is that the drive means comprise a step motor. A step motor has the possibility to adjust the position of the pilot valve element with a high precision.

Furthermore it is preferred that a spring means is arranged between said pilot valve element and said drive means. A solenoid usually only acts in one direction. When the solenoid is not energized, the spring can close the valve.

A preferred example of the invention will now be described in more detail with reference to the drawing, wherein:

DETAILED DESCRIPTION

Figure 1:
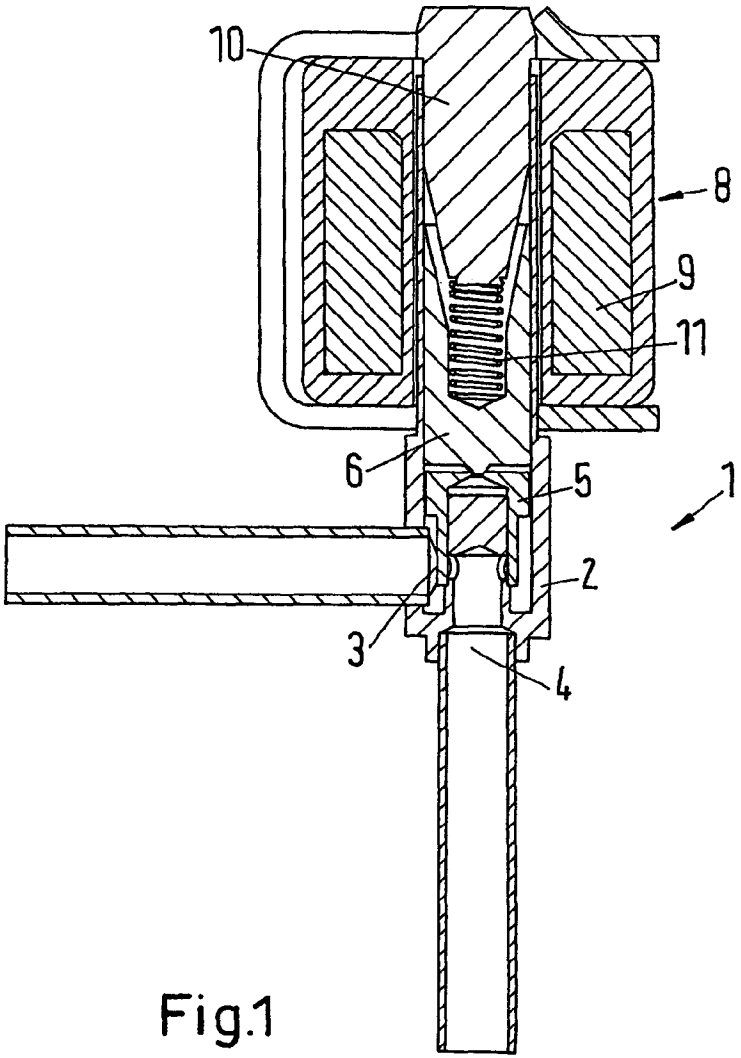
FIG. 1 is a diagrammatic section through a proportional valve having an electromagnetic actuator and FIG. 2 is an enlarged view of the part of FIG. 1.
Figure 2:
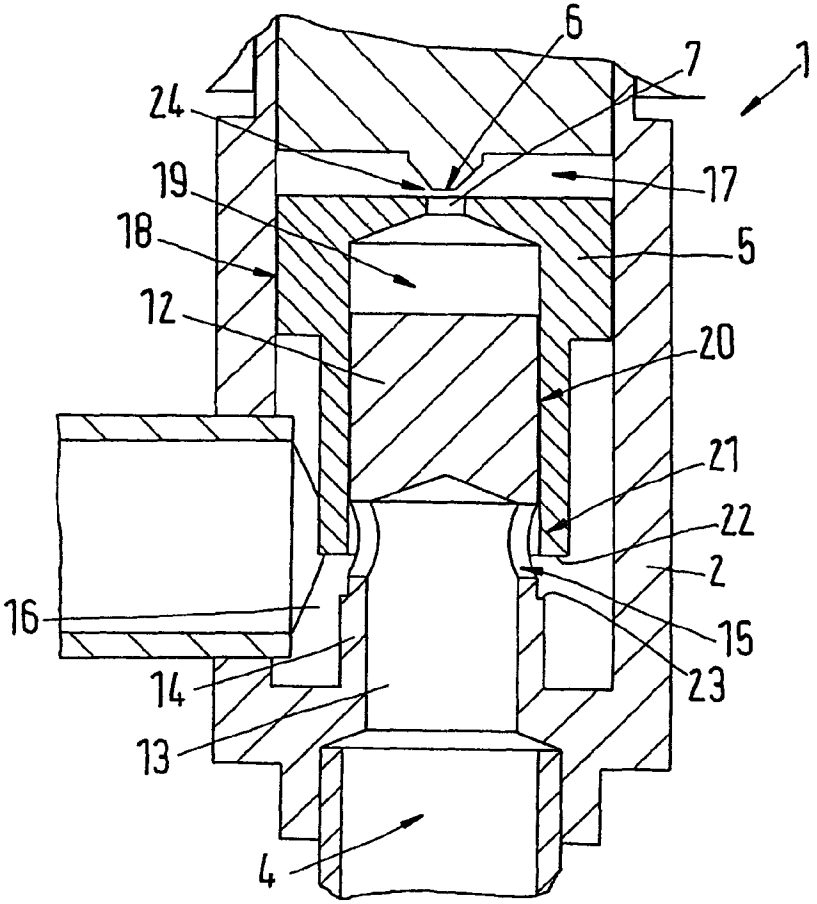

FIG. 1 shows a valve 1 which can be used as proportional valve, said valve 1 has a housing 2. The housing 2 comprises an inlet 3 and an outlet 4. A valve element 5 is arranged to control a flow resistance between the inlet 3 and the outlet 4.

The valve element 5 is actuated by means of a servo-system having a pilot valve. The pilot valve is formed by means of a pilot valve element 6 and a pilot valve opening 7, said pilot valve opening 7 being provided in the valve element 5. Furthermore, the servo-system comprises an electromagnetic actuator 8 having a solenoid 9 and a yoke 10 acting on the pilot valve element 6 via a spring 11 as will be explained further.

The housing 2 comprises a part 12 which can be made integrally with the housing 2 or can be fixed to the housing 2. The housing part 12 defines an outlet channel 13 which is directly connected to the outlet 4. The outlet channel 13 is surrounded by a wall 14. The wall 14 has some openings 15.

The inlet 3 is connected to a first pressure chamber 16 within the housing. Therefore, the pressure of the inlet 3 is present in the first pressure chamber 16. The pressure in the first pressure chamber 16 acts on the valve element 5 in a first direction. This first direction is also briefly termed as "opening direction".

As the opposite side of the valve element 7 there is a second pressure chamber 17. The pressure in the second pressure chamber 17 acts in a second direction which is opposite to the first direction. The second direction is briefly termed as "closing direction". The second pressure chamber 17 is connected to the first pressure chamber 16 by means of a throttled flow path 18 which can be made by a clearance between the valve element 5 and the housing 2.

The valve element 5 together with the part 12 of the housing defines a third pressure chamber 19. The third pressure chamber 19 is connected to the outlet channel 13 via a throttled flow path 20 which can be as well formed by a clearance between the valve element 5 and the part 12.

The valve element 5 comprises a sleeve part 21, said sleeve part 21 having an edge 22 at its free end. Said edge 22 is moveable over said openings 15 so that the sleeve part 21 more or less covers the openings 15.

When the valve element 5 has been moved to a fully closed position the edge 22 rests against a valve seat 23 so that no gap leakages can occur.

The valve 1 works as follows:

It is assumed that the valve element 5 is in fully closed position, i.e. the edge 22 rests against the valve seat 23 and the openings 15 are fully covered by the sleeve part 21.

In this situation it is assumed that the pressure at the inlet 3 is 100% and the pressure at the outlet 4 is 0%. The pressure at the inlet 3 is transmitted to the second pressure chamber 17 via the throttled flow path 18. On the other hand, the pressure in the third pressure chamber 19 is equal to the pressure at the outlet 4, i.e. 0%. The pressure difference over the pilot valve therefore is 100%.

This differences in pressure provide a force that has to be overcome. The pressure in the second pressure chamber 17 is present also on the side of the pilot valve element 11 opposite to the pilot valve opening 7. However, the area on which the pressure acts in a direction towards the pilot valve opening 7 is somewhat larger than the area on the opposite direction. The part of the pilot valve element 6 closing the pilot valve opening 7 is subjected to 0% pressure. The pressure difference over the pilot valve creates a force that has to be overcome. This force is rather large which makes it advantageous to have a "two-step electromagnetic actuator" according to US 2010/0327202 A1 that provides a large force in the first stage of movement, which has, however, only a small travel.

Once the pilot valve element 6 has been moved to open the pilot valve, i.e. to create a gap 24 between the pilot valve element 6 and the valve element 5, fluid can flow into the pilot valve opening 7. There is a fluid flow from the inlet into the first pressure chamber 16 through the throttled flow path 18 into the second pressure chamber 17, and from the second pressure chamber 17 through the gap 24 and the pilot valve opening 7 into the third pressure chamber 19 and from there through the throttled flow path 20 into the outlet channel 13 and the outlet 4. This causes a significant pressure loss at the throttled flow path 18, the gap 24 and the throttled flow path 20. This will have the result that the pressure in the second pressure chamber 17 is smaller than the pressure in the first pressure chamber 16 and the pressure in the third pressure chamber 19 is smaller than the pressure in the second pressure chamber 17. However, the pressure in the third pressure chamber 19 is still larger than the pressure at the outlet 4.

Such a pressure distribution can be adjusted by choosing appropriate flow resistances of the two throttled flow paths 18, 20. In the present example it can be seen that the throttled flow path 18 is of shorter length than the throttled flow path 20.

In order to facilitate the explanation it is assumed that the pressure in the first pressure chamber 16 is 100%. The pressure in the second pressure chamber 17 is 75%. The pressure in the third pressure chamber 19 is 50% and the pressure at the outlet 4 is 0%. This means that the differential pressure over the pilot valve is 75%-50%=25%. This pressure difference has to be overcome in order to move the pilot valve element 6. This force is much smaller than a force generated by a pressure difference as it was known in the prior art.

When a two-step actuator is used it gives a large travel in the second stage but only little force.

In all cases the pilot valve element 6 controls the position of the valve element 5 as the increase of the gap 24 will cause decreasing pressure in the second pressure chamber 17 and increasing pressure in the third pressure chamber 19 and thus a larger force on the valve element 5 in the opening direction (the annular area between the part 12 and the inside of the housing 2). Thus the valve element 5 will always follow the pilot valve element 6.

Since the forces necessary for moving the pilot valve element 6 are smaller the consumption of electrical power can be reduced.

The embodiment shown in FIG. 1 shows an electromagnetic actuator 8. It is however possible to use another drive means, e.g. a step motor.

Although various embodiments of the present invention have been described and shown, the invention is not restricted thereto, but may also be embodied in other ways within the scope of the subject-matter defined in the following claims.

What is claimed is:

1. A valve comprising:

a housing having an inlet and an outlet, the outlet having an outlet pressure, a valve element being positioned between said inlet and said outlet, said valve element being moveable in said housing, said valve element comprising:

a pilot valve opening, a first pressure chamber, a first pressure in said first pressure chamber acting on said valve element in a first direction, a second pressure chamber, a second pressure in said second pressure chamber acting on said valve element in a second direction opposite to said first direction, and a pilot valve element cooperating with said pilot valve opening to form a pilot valve, said pilot valve element being actuated by drive means, wherein a flow resistance between said inlet and said first pressure chamber is smaller than a flow resistance between said inlet and said second pressure chamber, wherein said pilot valve opens into a third pressure chamber, said third pressure chamber being connected to said outlet via a throttled flow path that restricts flow from the third pressure chamber to the outlet such that a third pressure in said third pressure chamber is greater than the outlet pressure, and wherein closing of said pilot valve causes the inlet and the third pressure chamber to become fluidly disconnected.

2. The valve according to claim 1, wherein said third pressure chamber is formed between said valve element and a part of said housing.

3. The valve according to claim 2, wherein said valve element is formed as a slider surrounding said part of the housing.

4. The valve according to claim 2, wherein said throttled flow path is arranged between said valve element and said part of the housing.

5. The valve according to claim 2, wherein an outlet channel is arranged within said part of the housing, said outlet channel being connected to said outlet, said valve element comprising a sleeve part, said sleeve part defining a control edge, said control edge being moveable over an opening in a wall of the outlet channel, said opening connecting said outlet channel to said first pressure chamber.

6. The valve according to claim 5, wherein said part of the housing defines a valve seat against which the valve element rests when said valve is closed.

7. The valve according to claim 1, wherein said drive means have a two-step actuation.

8. The valve according to claim 1, wherein said drive means comprise an electromagnetic actuator.

9. The valve according to claim 1, wherein valve means comprise a step motor.

10. The valve according to claim 1, wherein a spring means is arranged between said pilot valve element and said drive means.

* * * * *